US007609225B2

(12) United States Patent
Chang

(10) Patent No.: US 7,609,225 B2
(45) Date of Patent: Oct. 27, 2009

(54) CLIPPING COMMUNICATION DEVICE

(75) Inventor: Gen-Yuan Chang, Taipei (TW)

(73) Assignee: Inventec Corporation, Taipei (TW)

( * ) Notice: Subject to any disclaimer, the term of this patent is extended or adjusted under 35 U.S.C. 154(b) by 459 days.

(21) Appl. No.: 11/656,973

(22) Filed: Jan. 24, 2007

(65) Prior Publication Data

US 2008/0036690 A1 Feb. 14, 2008

(30) Foreign Application Priority Data

Aug. 9, 2006 (TW) ..... 95129274 A

(51) Int. Cl.
*H01Q 1/12* (2006.01)

(52) U.S. Cl. ..... 343/878; 343/880

(58) Field of Classification Search ..... 343/702, 343/878, 880

See application file for complete search history.

(56) References Cited

U.S. PATENT DOCUMENTS

| | | | | |
|---|---|---|---|---|
| 5,551,069 | A * | 8/1996 | Harrison et al. | 455/575.6 |
| 6,067,057 | A * | 5/2000 | Yajima et al. | 343/878 |
| 2006/0197707 | A1 * | 9/2006 | Tsai et al. | 343/702 |
| 2007/0069891 | A1 * | 3/2007 | Wallace et al. | 340/539.15 |

* cited by examiner

*Primary Examiner*—Hoang V Nguyen
(74) *Attorney, Agent, or Firm*—Muncy, Geissler, Olds & Lowe, PLLC

(57) ABSTRACT

A clipping communication device includes a first clipping arm unit, a second clipping arm unit, an antenna module and a pivot unit. The first clipping arm unit includes a first force exerting portion and a first clipping portion. The second clipping arm unit has a second force exerting portion and a second clipping portion. The first force exerting portion is disposed corresponding to the second force exerting portion, and the first clipping portion is disposed corresponding to the second clipping portion. The antenna module is disposed in the first clipping arm unit. The pivot unit pivots on the first clipping arm unit and the second clipping arm unit.

16 Claims, 7 Drawing Sheets

1

CLIPPING COMMUNICATION DEVICE

BACKGROUND OF THE INVENTION

1. Field of Invention

The invention relates to a communication device, and, in particular, to a clipping communication device.

2. Related Art

With ever developing technology and the increasing quality of daily life, demands on product quality and convenience are also increased. Of course, there is no exception to demands on communication devices. As for communication devices, a lot of convenience functions, such as portability, are required in addition to quality communication function. Referring to FIG. 1A, a conventional portable communication device 1, such as a USB wireless Ethernet adapter, at least has one antenna module 11 and one USB connector 12, which is electrically connected to the antenna module 11. The USB connector 12 functions to transmit and receive signals transmitted or received by the antenna module 11. When a user uses the communication device 1, as shown in FIG. 1B, the USB connector 12 of the communication device 1 is inserted into a socket (not shown) of a computer host 2 to enable the function of communication device 1.

However, the socket in the back of the computer host 2 tends to be pressed and damaged under the weight of the communication device 1. In addition, the communication device 1 only can receive the signals coming from a specific orientation due to the shielding effect of the computer host 2, thereby deteriorating the communication quality. Furthermore, because the position of the socket of the computer host 2 is fixed, the user cannot place the communication device 1 according to his/her requirements and is thus inconvenienced.

Thus, it is an important subject of the invention to provide a communication device capable of solving the above-mentioned problem.

SUMMARY OF THE INVENTION

In view of the foregoing, the invention is to provide a clipping communication device capable of being disposed at various positions.

To achieve the above, the invention discloses a clipping communication device including a first clipping arm unit, a second clipping arm unit, an antenna module and a pivot unit. The first clipping arm unit has a first force exerting portion and a first clipping portion. The second clipping arm unit has a second force exerting portion and a second clipping portion. The first force exerting portion is disposed corresponding to the second force exerting portion, and the first clipping portion is disposed corresponding to the second clipping portion. The antenna module is disposed in the first clipping arm unit. The pivot unit pivots on the first clipping arm unit and the second clipping arm unit.

As mentioned above, the clipping communication device of the invention has the first clipping portion and the second clipping portion, so the user can bring the first clipping portion to the second clipping portion together in order to clip the object, to support the weight of the clipping communication device, and thus to prevent the socket from being stressed and lengthen the product lifetime. In addition, the user may also clip the clipping communication device at position with the good signal reception so as to enhance the communication quality. Furthermore, the user may also dispose the clipping communication device at the proper position according to his/her convenience.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1B:
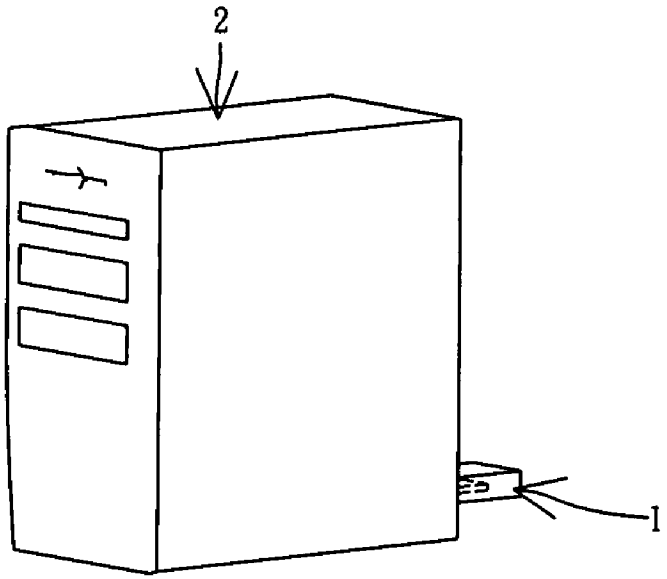
FIG. 1B (PRIOR ART)
FIG. 1B is a schematic illustration showing an assembled state of the conventional communication device and a computer host of FIG. 1A.
Figure 1A:
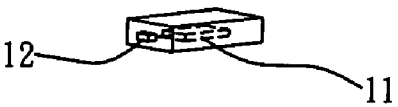
FIG. 1A (PRIOR ART)
FIG. 1A is a schematic illustration showing a conventional communication device.
Figure 2:
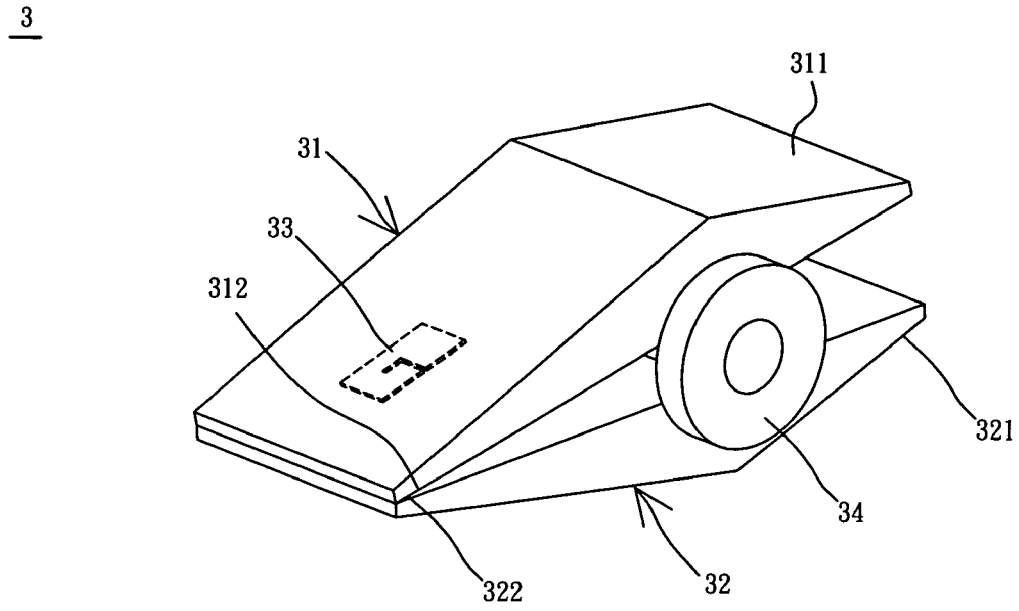
FIG. 2 is a schematic illustration showing a clipping communication device according to a preferred embodiment of the invention.

Referring to FIG. 2, a clipping communication device 3 according to the preferred embodiment of the invention includes a first clipping arm unit 31, a second clipping arm unit 32, an antenna module 33 and a pivot unit 34.

The first clipping arm unit 31 has a first force exerting portion 311 and a first clipping portion 312, and the second clipping arm unit 32 has a second force exerting portion 321 and a second clipping portion 322. The first force exerting portion 311 is disposed corresponding to the second force exerting portion 321, and the first clipping portion 312 is disposed corresponding to the second clipping portion 322. In addition, the antenna module 33 is disposed in the first clipping arm unit 31, and the pivot unit 34 pivots on the first clipping arm unit 31 and the second clipping arm unit 32.

In this embodiment, the pivot unit 34 is disposed between the first force exerting portion 311 and the first clipping portion 312, and the pivot unit 34 is disposed between the second force exerting portion 321 and the second clipping portion 322. So, the user may exert forces to the first force exerting portion 311 and the second force exerting portion 321 to drive the first force exerting portion 311 and the second force exerting portion 321 toward each other, thus parting the first clipping portion 312 from the second clipping portion 322. On the contrary, as shown in FIG. 3, if the user applies forces to the first force exerting portion 311 and the second force exerting portion 321 to part the first force exerting portion 311 from the second force exerting portion 321, the first force exerting portion 311 and the second force exerting portion 321 drive the first clipping portion 312 and the second clipping portion 322 toward each other.

Figure 4:
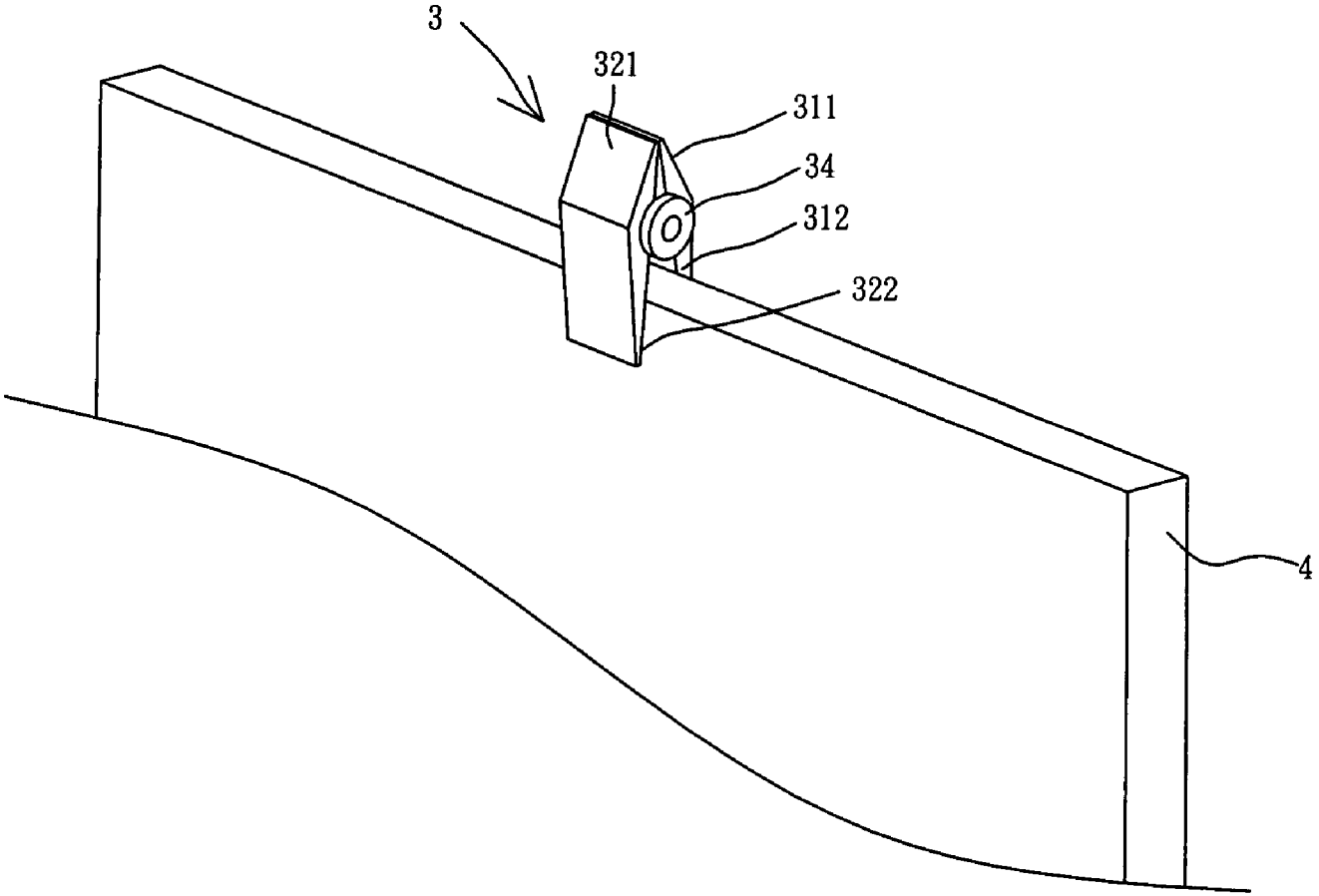
FIG. 4 is a schematic illustration showing a state when the clipping communication device of FIG. 2 clips an object.

In addition, as shown in FIG. 4, the clipping communication device 3 may cooperate with an object 4, which may be a casing, such as a casing of a display, a casing of a lamp holder, a computer casing or a window casing. Of course, the object 4 may also be a table frame, a lamp stand, a book shelf or a window frame. In this embodiment, the object 4 is the casing of a notebook computer. At this time, the user may part the first force exerting portion from the second force exerting portion. In this case, the first clipping portion 312 and the second clipping portion 322 approach each other to clip the object 4 so as to support the weight of the clipping communication device 3, to prevent the socket (not shown) from being stressed, and thus to lengthen the product lifetime. In addition, the user may also clip the clipping communication device 3 at a position with the better signal receiving quality to enhance the communication quality. Furthermore, the user may also choose to clip the clipping communication device 3 at a proper position according to his/her convenience and usage requirements.

Figure 5:
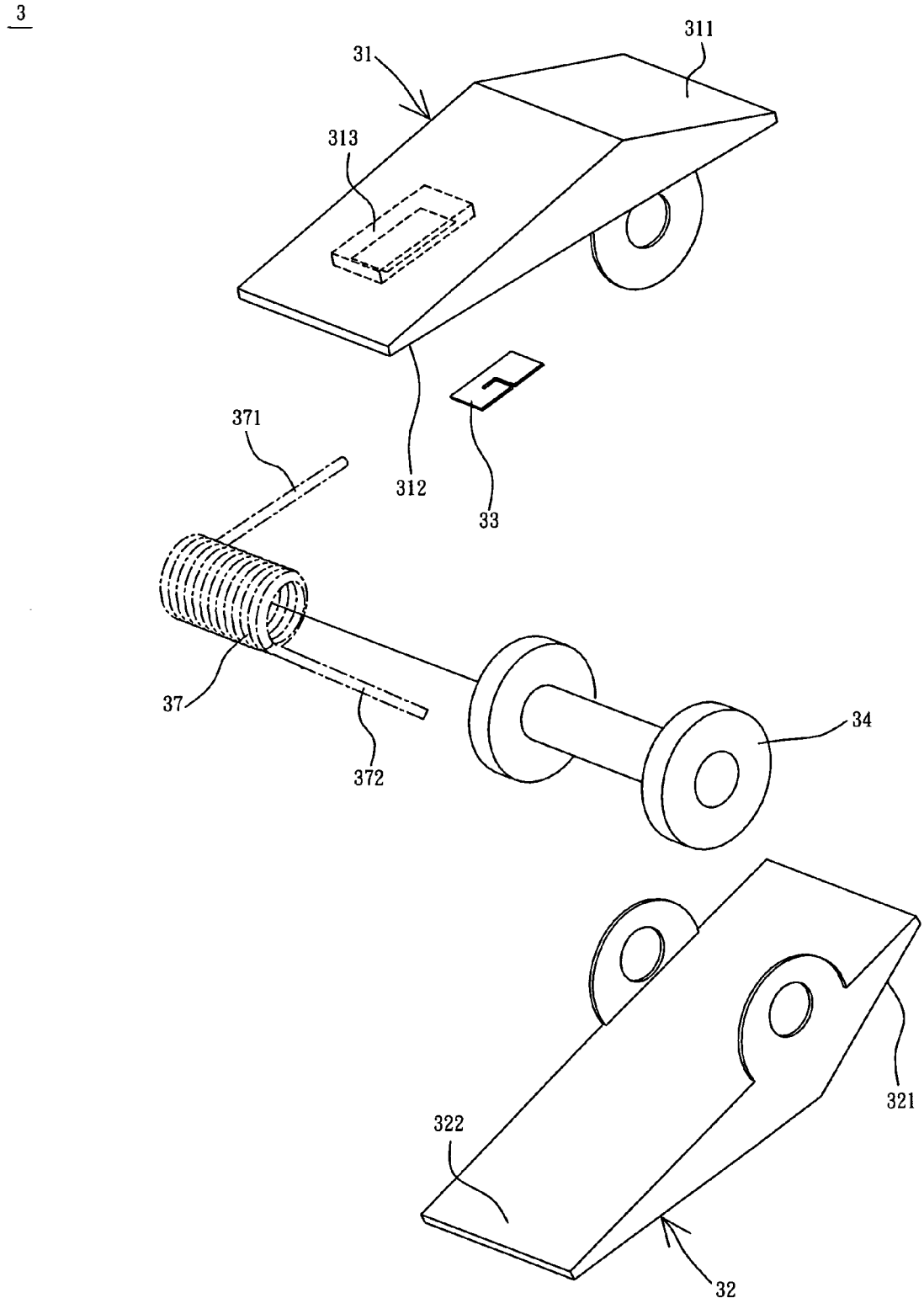
FIG. 5 is a schematically exploded view showing the clipping communication device of FIG. 2.

Referring to FIG. 5, the clipping communication device 3 may further include an elastic unit 37, which houses the pivot unit 34 and has one end 371 connected to an inner side of the first clipping arm unit 31 and the other end 372 connected to an inner side of the second clipping arm unit 32. The elastic unit 37 may be a spring or an elastic sheet. In this embodiment, the elastic unit 37 is a spring.

Figure 3:
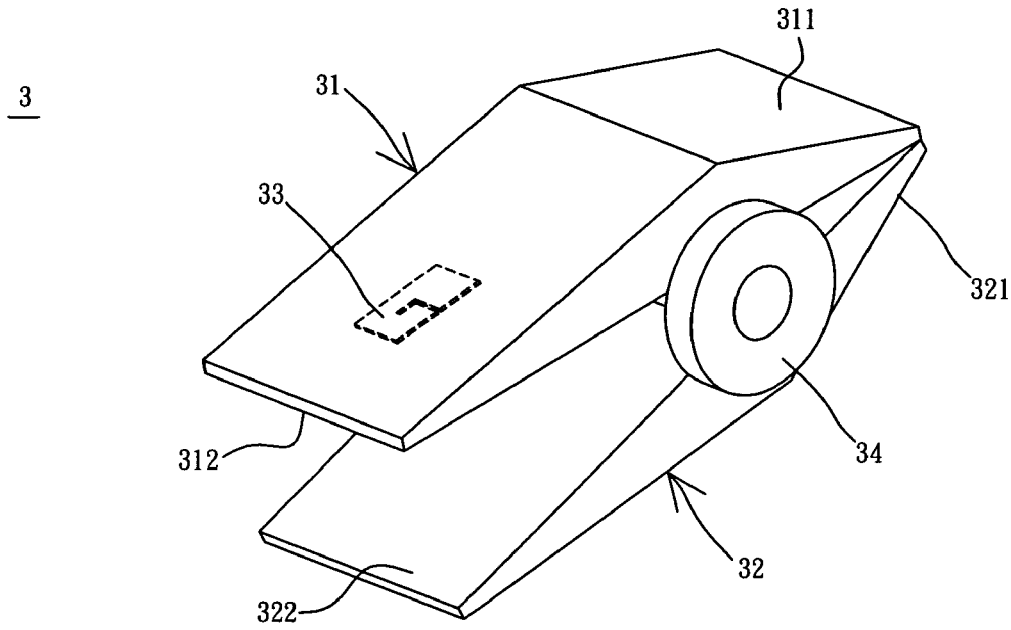
FIG. 3 is a schematic illustration showing the clipping communication device according to the preferred embodiment of the invention, wherein a first clipping portion is separated from a second clipping portion.

As shown in FIGS. 3 and 5, the user may exert forces to the first force exerting portion 311 and the second force exerting portion 321 to drive the first force exerting portion 311 and the second force exerting portion 321 toward each other. At this time, the two ends 371 and 372 of the elastic unit 37 are pressed to store the elastic potential energy. When the user stops exerting the forces to the first force exerting portion 311 and the second force exerting portion 321, as shown in FIGS. 2 and 5, the elastic unit 37 releases the elastic potential energy and parts the first force exerting portion 311 from the second force exerting portion 321 through the two ends 371 and 372. Thus, the first clipping portion 312 and the second clipping portion 322 approach other to clip the object subsequently.

In addition, as shown in FIG. 5, the first clipping arm unit 31 further includes a first containing portion 313. The first containing portion 313 is a concave portion or a closed chamber. The antenna module 33 is disposed in the first containing portion 313. In this embodiment, if the first containing portion 313 is a concave portion, a side surface of the antenna module 33 is exposed from the concave portion and thus the antenna module 33 can be assembled or replaced conveniently. Alternatively, if the first containing portion 313 is a closed chamber, the antenna module 33 is covered by the first clipping arm unit 31. So, it is possible to prevent the antenna module 33 from being influenced by environmental factors, such as the dust or moisture.

Figure 6:
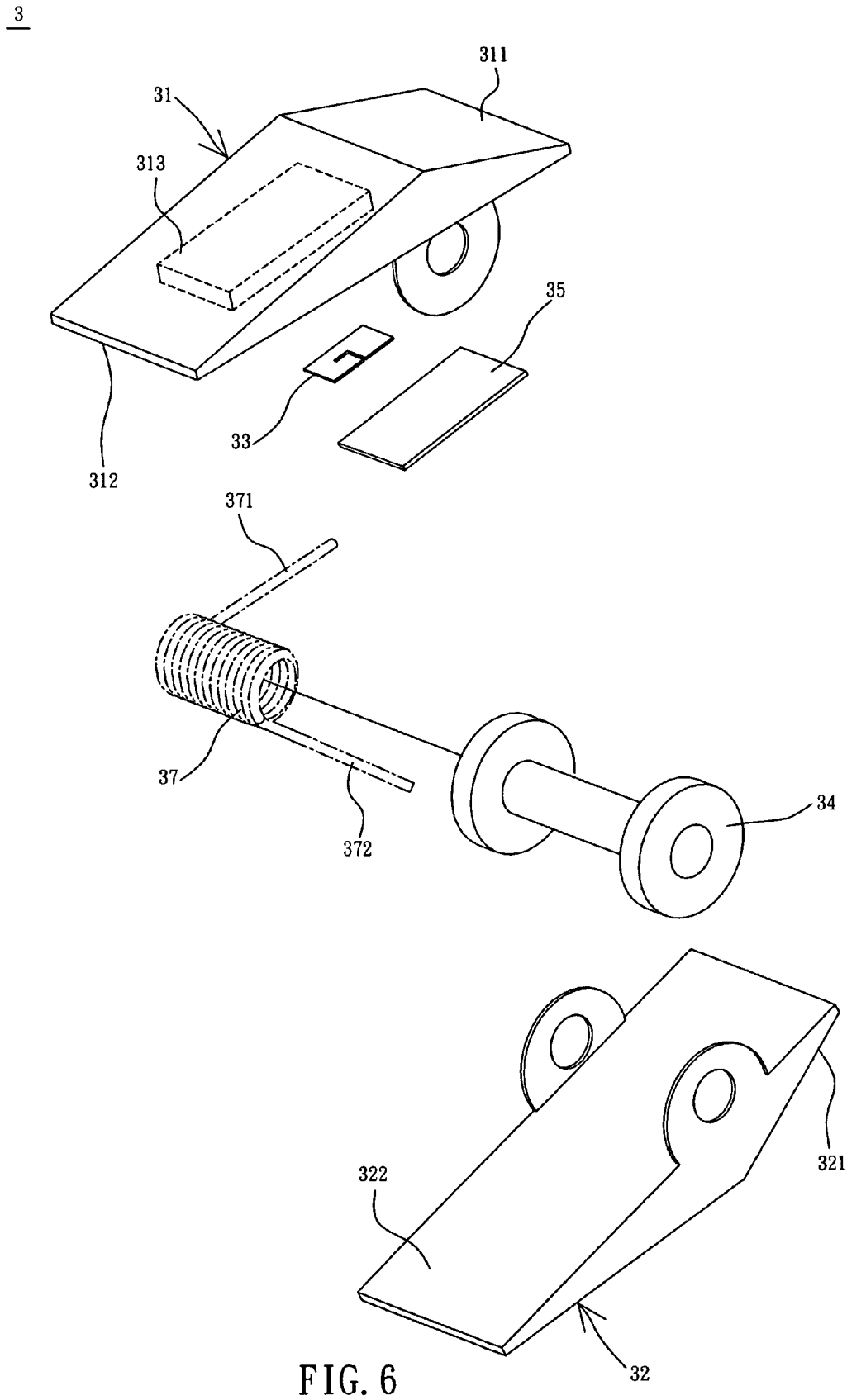
FIG. 6 is a schematically exploded view showing another clipping communication device according to the preferred embodiment of the invention, wherein an antenna module and a circuit board are disposed in a first containing portion of a first clipping arm unit.
Figure 7:
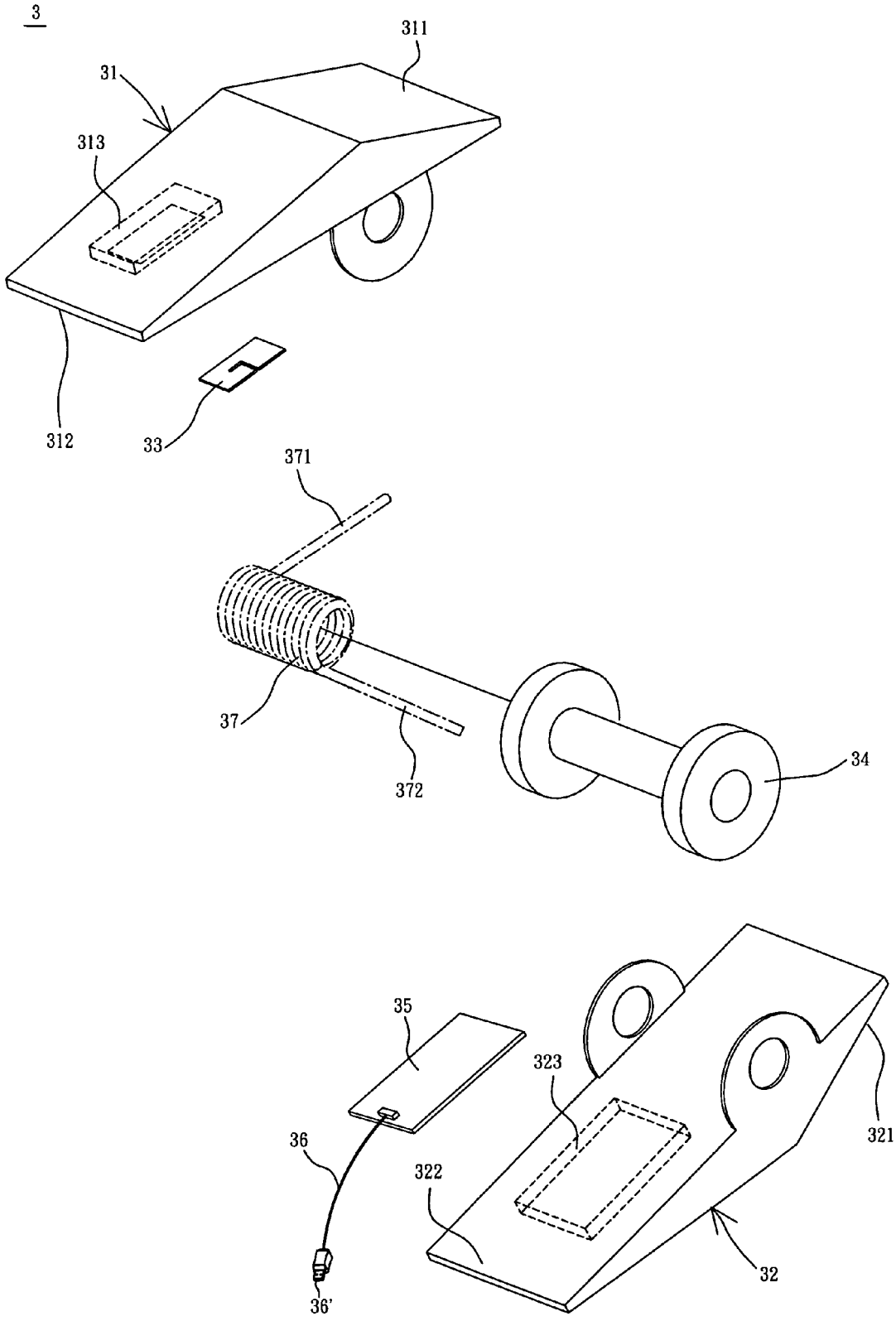
FIG. 7 is a schematically exploded view showing still another clipping communication device according to the preferred embodiment of the invention, wherein the antenna module is disposed in the first containing portion of the first clipping arm unit, and the circuit board is disposed in a second containing portion of a second clipping arm unit.

Furthermore, referring to FIGS. 6 and 7, the clipping communication device 3 further includes a circuit board 35, which is electrically connected to the antenna module 33. The circuit board 35 may be flexibly disposed according to the actual condition. For example, as shown in FIG. 6, the circuit board 35 may be disposed in the first containing portion 313 of the first clipping arm unit 31. Alternatively, as shown in FIG. 7, the circuit board 35 may also be disposed in a second containing portion 323 of the second clipping arm unit 32.

Also, as shown in FIG. 7, the clipping communication device 3 further includes a transmission cable 36 and a connector 36'. The transmission cable 36 is electrically connected to the circuit board 35 and the connector 36'. The transmission cable 36 transmits the signal, which is received or transmitted by the antenna module 33, through the circuit board 35. The transmission cable 36 may have different designs, such as a RS232 transmission cable, a 1394 transmission cable or a USB transmission cable, according to the actual requirement. In this embodiment, the transmission cable 36 is the USB transmission cable, and the connector 36' is the USB connector.

Figure 8:
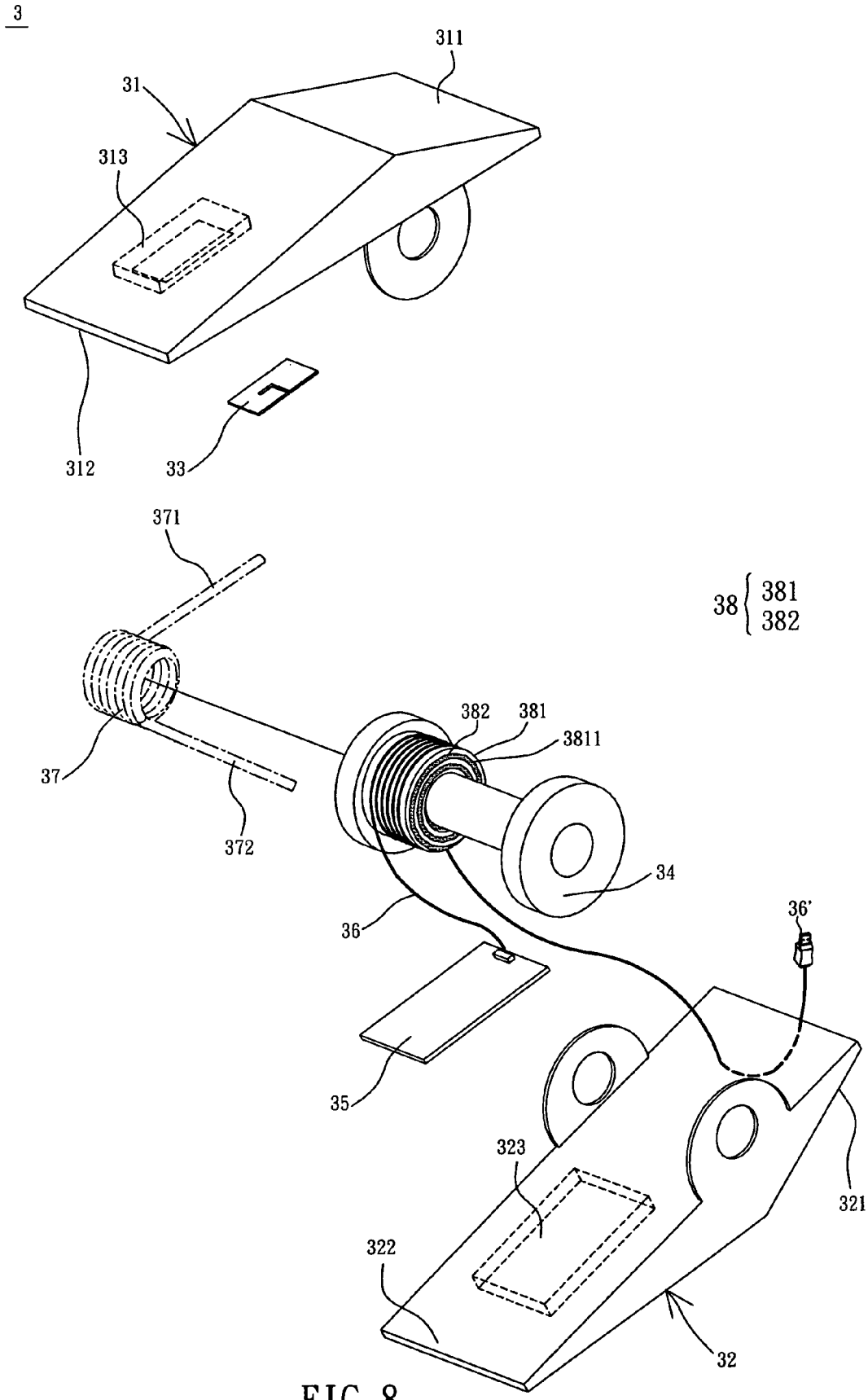
FIG. 8 is a schematically exploded view showing yet still another clipping communication device according to the preferred embodiment of the invention, wherein a portion of a transmission cable is retracted into a retracting unit.

In addition, at least one portion of the transmission cable 36 may be retracted in the pivot unit 34 to facilitate the management of the transmission cable 36. Of course, as shown in FIG. 8, the clipping communication device 3 may further include a retracting unit 38 for retracting at least one portion of the transmission cable 36. In this embodiment, the retracting unit 38 includes a reel 381 and a vortex spring 382. The reel 381 pivots on the pivot unit 34 and has a vortex groove 3811 for accommodating the vortex spring 382. The transmission cable 36 surrounds the outer edge of the reel 381. The vortex spring 382 has sufficient resilience to rotate the reel 381, so the transmission cable 36 can be easily retracted on the reel 381, or the transmission cable 36 retracted on the reel 381 may be pulled out for use. For example, the user can pull out the transmission cable 36 retracted on the reel 381, connect the connector 36' to a socket (not shown) of the notebook computer, and then clip the clipping communication device 3 on the casing (not shown) of the notebook computer to support the weight of the clipping communication device 3, to prevent the socket of the notebook computer from being stressed, and thus to lengthen the product lifetime. In addition, the user may also clip the clipping communication device 3 at a position with the good signal reception so as to enhance the communication quality. Furthermore, the user may also dispose the clipping communication device 3 at a proper position according to his/her convenience.

In summary, the clipping communication device of the invention has the first clipping portion and the second clipping portion, so the user can bring the first clipping portion to the second clipping portion together in order to clip the object, to support the weight of the clipping communication device, and thus to prevent the socket from being stressed and lengthen the product lifetime. In addition, the user may also clip the clipping communication device at position with the good signal reception so as to enhance the communication quality. Furthermore, the user may also dispose the clipping communication device at the proper position according to his/her convenience.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A clipping communication device, comprising:

a first clipping arm unit having a first force exerting portion and a first clipping portion;

a second clipping arm unit having a second force exerting portion and a second clipping portion, wherein the first force exerting portion is disposed corresponding to the second force exerting portion and the first clipping portion is disposed corresponding to the second clipping portion;

an antenna module disposed in the first clipping arm unit; and a pivot unit pivoting on the first clipping arm unit and the second clipping arm unit.

2. The device according to claim 1, wherein the pivot unit is disposed between the first force exerting portion and the first clipping portion, and the pivot unit is disposed between the second force exerting portion and the second clipping portion.

3. The device according to claim 1 cooperated with an object, wherein when the first force exerting portion parts from the second force exerting portion, the first clipping portion approaches the second clipping portion to clip the object.

4. The device according to claim 3, wherein the object is a casing.

5. The device according to claim 1, wherein the first clipping arm unit further comprises a first containing portion and the antenna module is disposed in the first containing portion.

6. The device according to claim 5, wherein the first containing portion is a concave portion or a closed chamber.

7. The device according to claim 1, further comprising:

a circuit board electrically connected to the antenna module.

8. The device according to claim 7, wherein the circuit board is disposed in the first clipping arm unit.

9. The device according to claim 7, wherein the circuit board is disposed in the second clipping arm unit.

10. The device according to claim 9, wherein the second clipping arm unit further comprises a second containing portion, and the circuit board is disposed in the second containing portion.

11. The device according to claim 7, further comprising:

a transmission cable electrically connected to the circuit board.

12. The device according to claim 11, wherein at least one portion of the transmission cable is retracted in the pivot unit.

13. The device according to claim 11, wherein the transmission cable is a USB (Universal Serial Bus) transmission cable.

14. The device according to claim 11, further comprising:

a retracting unit for retracting at least one portion of the transmission cable.

15. The device according to claim 1, further comprising:

an elastic unit, which houses the pivot unit and has one end connected to the first clipping arm unit and the other end connected to the second clipping arm unit.

16. The device according to claim 15, wherein the elastic unit is a spring or an elastic sheet.

* * * * *